US011147350B2

(12) United States Patent
Ruan et al.

(10) Patent No.: US 11,147,350 B2
(45) Date of Patent: Oct. 19, 2021

(54) MODULAR STRUCTURE OF AN INTERIOR ASSEMBLY

(71) Applicant: Anhui Korrun Co., Ltd, Chuzhou (CN)

(72) Inventors: Ruping Ruan, Jiaxing (CN); Jidong Yang, Shanghai (CN); Xuan Feng, Shanghai (CN); Lili Jiang, Shanghai (CN); Dongping Zhang, Shanghai (CN); Shichang Mao, Shanghai (CN); Zhixin Liu, Shanghai (CN); Su Zhang, Shanghai (CN); Jinsong Fan, Shanghai (CN)

(73) Assignee: ANHUI KORRUN CO., LTD, Chuzhou (CN)

( * ) Notice: Subject to any disclaimer, the term of this patent is extended or adjusted under 35 U.S.C. 154(b) by 385 days.

(21) Appl. No.: 16/438,471

(22) Filed: Jun. 12, 2019

(65) Prior Publication Data

US 2020/0000197 A1 Jan. 2, 2020

(30) Foreign Application Priority Data

Jun. 27, 2018 (CN) ..... 201820996551.1

(51) Int. Cl.
*A45C 13/04* (2006.01)
*A45C 5/03* (2006.01)

(52) U.S. Cl.
CPC ..... *A45C 13/04* (2013.01); *A45C 5/03* (2013.01); *A45C 2005/037* (2013.01)

(58) Field of Classification Search
CPC ..... A45C 13/04; A45C 5/03; A45C 2005/037
See application file for complete search history.

(56) References Cited

U.S. PATENT DOCUMENTS

| | | | | | |
|---|---|---|---|---|---|
| 2,758,682 | A * | 8/1956 | Shwayder | A45C 5/02 | 190/28 |
| 3,737,980 | A * | 6/1973 | Kotkins | A45C 5/02 | 29/515 |
| 3,780,838 | A * | 12/1973 | Sian | A45C 5/02 | 190/121 |
| 3,896,909 | A * | 7/1975 | Kellett | A45C 5/02 | 190/122 |
| 5,111,920 | A * | 5/1992 | Castelli | A45C 5/03 | 190/120 |

(Continued)

*Primary Examiner* — Tri M Mai
(74) *Attorney, Agent, or Firm* — Bayramoglu Law Offices LLC

(57) ABSTRACT

A modular structure of an interior assembly relates to the field suitcases. A first snap-fit groove is provided around an outer side of a middle frame, and an opening of the first snap-fit groove is provided downward. A second snap-fit groove is provided around an inner side of the middle frame, a first protrusion and a sliding member are provided in the second snap-fit groove, and an opening of the second snap-fit groove is provided upward. An upper end of a shell is snap-fitted into the first snap-fit groove to be combined with the middle frame, and the card is combined with the inner assembled structure. Subsequently, the card is inserted into the second snap-fit groove, the second protrusion fixes the card in the second snap-fit groove through the sliding member and the first protrusion, and the step-like member and the sliding member are fixed by a snap-fit connection.

7 Claims, 2 Drawing Sheets

(56) References Cited

U.S. PATENT DOCUMENTS

| | | | | | |
|---|---|---|---|---|---|
| 5,168,968 | A * | 12/1992 | Fritze | A45C 5/02 | 190/122 |
| 5,358,083 | A * | 10/1994 | Ku | A45C 5/02 | 150/125 |
| 6,971,517 | B2 * | 12/2005 | Chen | B25H 3/02 | 190/122 |
| 9,307,815 | B2 * | 4/2016 | Sijmons | A45C 5/03 | |

* cited by examiner

MODULAR STRUCTURE OF AN INTERIOR ASSEMBLY

CROSS REFERENCE TO THE RELATED APPLICATIONS

This application is based upon and claims priority to Chinese Patent Application No. 201820996551.1, filed on Jun. 27, 2018, the entire contents of which are incorporated herein by reference.

TECHNICAL FIELD

The present invention relates to the field of the interior assembly of suitcases, in particular to a modular structure of an interior assembly.

BACKGROUND

The production of suitcases includes two parts, i.e., forming of a shell and assembly of a case body. The assembly of the case body includes steps of assembling wheels, assembling internal structures with machine sewing, and installing a handle. The step of assembling the internal structures with machine sewing mainly refers to an achievement of fixation between an inner fabric layer and the shell through the machine sewing or a bonding between the inner fabric layer and an outer glue strip. The process relies on manual operation, and at the same time, the machine sewing process is prone to cause a decrease in the mechanical properties of the shell.

SUMMARY

The objective of the present invention is to provide a modular structure of an interior assembly for overcoming the defects and deficiencies of the prior art, which improves an automation degree of an interior assembly of a suitcase, and optimizes an assembly accuracy.

To achieve the above objective, the technical solution of the present invention is as follows. The modular structure of the interior assembly includes the shell 1, the middle frame 2, the card 3, and the inner assembled structure 4. The middle frame 2 includes the first snap-fit groove 2-1, the second snap-fit groove 2-2, the first protrusion 2-3, and the sliding member 2-4. The first snap-fit groove 2-1 is provided around an outer side of the middle frame 2, and an opening of the first snap-fit groove 2-1 is provided downward. The second snap-fit groove 2-2 is provided around an inner side of the middle frame 2, the first protrusion 2-3 and the sliding member 2-4 are provided in the second snap-fit groove 2-2, and an opening of the second snap-fit groove 2-2 is provided upward. The card 3 includes the second protrusion 3-1, and the step-like member 3-2, the card 3 is U-shaped, the second protrusion 3-1 is an upper end of the card 3, and the step-like member 3-2 is a lower end of the card 3. An upper end of the shell 1 is snap-fitted into the first snap-fit groove 2-1 to be connected to the middle frame 2, and the card 3 is combined with the inner assembled structure 4. The card 3 is inserted into the second snap-fit groove 2-2, the second protrusion 3-1 fixes the card 3 in the second snap-fit groove 2-2 through the sliding member 2-4 and the first protrusion 2-3, and the step-like member 3-2 and the slide member 2-4 are fixed through a snap-fit connection.

The shell 1 and the middle frame 2 are bonded and fixed by an adhesive through the first snap-fit groove 2-1.

The middle frame 2 is an integral injection moulding part.

The inner assembled structure 4 is connected to the card 3 through a machine sewing, and the inner assembled structure 4 is machine sewn on an outer side of the card 3 without a snap-fit member.

An upper part of the first protrusion 2-3 and an upper part of the sliding member 2-4 are respectively provided with a downward inclined plane.

A lower surface of the second protrusion 3-1 is an upward inclined plane, and an inclination angle of the upward inclined plane corresponds to an angle formed between the first protrusion 2-3 and the sliding member 2-4.

A radian of the step-like member 3-2 is matched with that of the sliding member 2-4, and the step-like member 3-2 and the sliding member 2-4 are directly fixed by the snap-fit connection.

The working principle of the present invention is as follows. The various components of the suitcase are produced by using the modular template, and then the various components are assembled by a simple method according to the principles of the snap-fit groove, the snap-fit, the machine sewing, and special structural characteristics of each component.

By implementing the above technical solution, the present invention has the following advantages. The assembly process is simple, and the assembly structure is firm, which improves the automation degree of the interior assembly of suitcases, and optimizes the assembly accuracy. Moreover, the assembly process is time-saving and labor-saving, thus greatly reducing the manual cost. Therefore, the invention is suitable for popularization and application.

BRIEF DESCRIPTION OF THE DRAWINGS

In order to explain the technical solution of the embodiment of the present invention or the prior art more clearly, the drawings used in the embodiment or the prior art will be briefly introduced hereinafter. Obviously, the drawings described below are only some embodiments of the present invention. For those of ordinary skill in the art, other drawings can be obtained according to these drawings without creative work.

Figure 1:
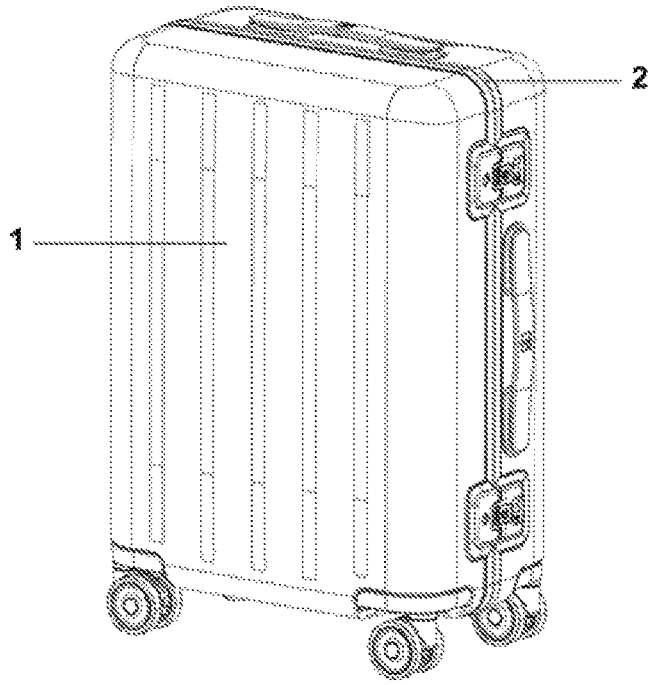
FIG. 1 is a structural schematic diagram of the present invention.

Description of the reference numerals: shell 1, middle frame 2, card 3, inner assembled structure 4, first snap-fit groove 2-1, second snap-fit groove 2-2, first protrusion 2-3, sliding member 2-4, second protrusion 3-1, step-like member 3-2.

DETAILED DESCRIPTION OF THE EMBODIMENTS

Figure 2:
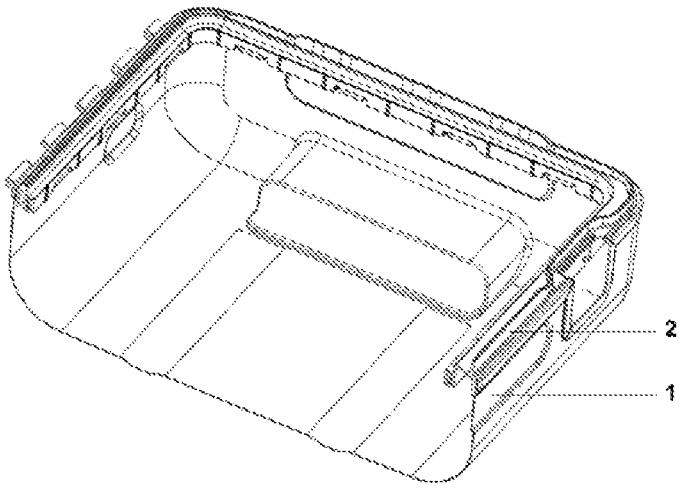
FIG. 2 is a cross-sectional view of the present invention.
Figure 3:
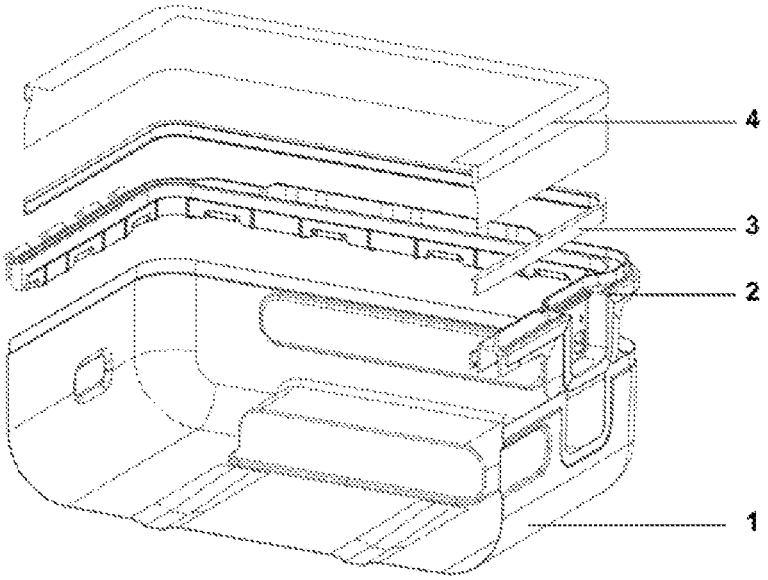
FIG. 3 is an exploded view of the present invention.
Figure 4:
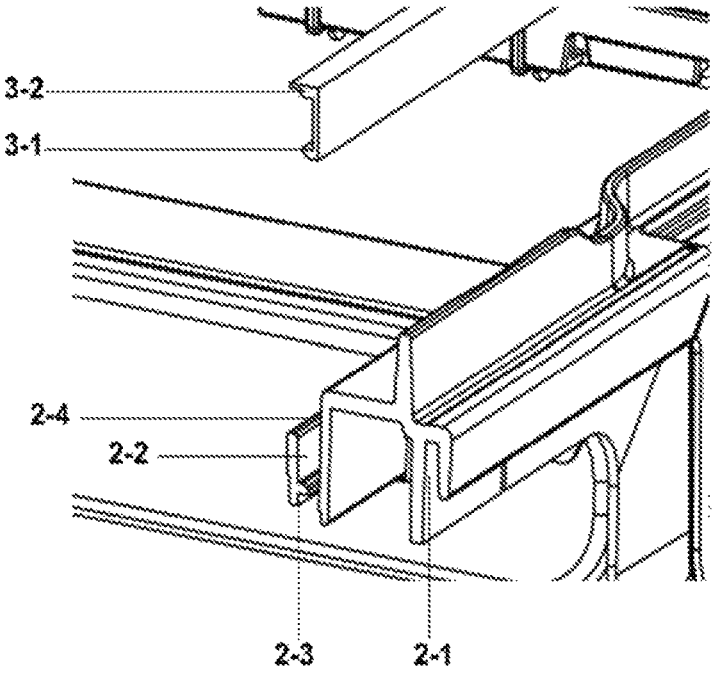
FIG. 4 is a structural schematic diagram showing the middle frame 2 and the card 3 of the present invention.

Referring to FIGS. 1-4, the technical scheme of the present embodiment is as follows. A modular structure of an interior assembly includes the shell 1, the middle frame 2, the first snap-fit groove 2-1, the second snap-fit groove 2-2, the first protrusion 2-3, the sliding member 2-4, the card 3, the second protrusion 3-1, the step-like member 3-2, and the inner assembled structure 4.

Firstly, the first snap-fit groove 2-1 of the middle frame 2 is coated with a glue, and then the shell 1 is placed in the first snap-fit groove 2-1. At the same time, the card 3 is combined with the inner assembled structure 4 by a machine sewing. Subsequently, the card 3 is inserted into the second snap-fit groove 2-2. At this time, the second protrusion 3-1 is fixed in the second snap-fit groove 2-2 by a snap-fit connection through the sliding member 2-4 and the first protrusion 2-3. The step-like member 3-2 is fixed with the sliding member 2-4 by a snap-fit connection. Subsequently, the inner assembled structure 4 is folded to an interior of the shell 1 to cover an inner side of the middle frame and attach to the shell 1.

The shell 1 and the middle frame 2 are bonded and fixed by an adhesive through the first snap-fit groove 2-1. The middle frame 2 is an integral injection moulding part, and the integral injection moulding part is provided with the first snap-fit groove 2-1 and the second snap-fit groove 2-2. The second snap-fit groove 2-2 is provided with the first protrusion 2-3 and the sliding member 2-4, and surfaces of both the first protrusion 2-3 and the sliding member 2-4 are downward inclined planes. The inner assembled structure 4 is machine sewn on an outer side of the card 3 without a snap-fit member. An interior of the card 3 is provided with the second protrusion 3-1 and the step-like member 3-2. A surface of the second protrusion 3-1 is an upward inclined plane, which has an inclination angle matched with an angle formed between the first protrusion 2-3 of the middle frame 2 and the sliding member 2-4. A radian of the step-like member 3-2 is matched with that of the sliding member 2-4, and the step-like member 3-2 and the sliding member 2-4 can be directly fixed by a snap-fit connection.

The working principle of the present invention is as follows. The various components of the suitcase are produced by using the modular template, and then the various components are assembled by a simple method according to the principles of the snap-fit groove, the snap-fit, the machine sewing, and special structural characteristics of each component.

By implementing the above technical solution, the present invention has the following advantages. The assembly process is simple, and the assembly structure is firm, which improves the automation of the interior assembly of suitcases, and optimizes the assembly accuracy. Moreover, the assembly process is time-saving and labor-saving, thus greatly reducing the manual cost. Therefore, the invention is suitable for popularization and application.

The above descriptions are only used to illustrate the technical scheme of the present invention, rather than limit the present invention. Other modifications or equivalent substitutions of the technical scheme of the present invention made by those of ordinary skill in the art without departing from the spirit and scope of the technical solution of the present invention should be covered in the scope of the claims of the present invention.

What is claimed is:

1. A modular structure of an interior assembly, comprising: a shell, a middle frame, a card, and an inner assembled structure; wherein the middle frame comprises a first snap-fit groove, a second snap-fit groove, a first protrusion, and a sliding member; the first snap-fit groove is provided around an outer side of the middle frame, and an opening of the first snap-fit groove is provided downward; the second snap-fit groove is provided around an inner side of the middle frame, the first protrusion and the sliding member are provided in the second snap-fit groove, and an opening of the second snap-fit groove is provided upward; the card comprises a second protrusion, and a step-like member, the card is U-shaped, the second protrusion is an upper end of the card, and the step-like member is a lower end of the card; an upper end of the shell is snap-fitted into the first snap-fit groove to be connected to the middle frame, and the card is combined with the inner assembled structure; the card is inserted into the second snap-fit groove, the second protrusion fixes the card in the second snap-fit groove through the sliding member and the first protrusion, and the step-like member and the slide member are fixed by a snap-fit connection.

2. The modular structure of the interior assembly according to claim 1, wherein the shell and the middle frame are bonded and fixed by an adhesive through the first snap-fit groove.

3. The modular structure of the interior assembly according to claim 1, wherein the middle frame is an integral injection moulding part.

4. The modular structure of the interior assembly according to claim 1, wherein the inner assembled structure is combined with the card through a machine sewing process, and the inner assembled structure is machine sewn on an outer side of the card without a snap-fit member.

5. The modular structure of the interior assembly according to claim 1, wherein an upper part of the first protrusion and an upper part of the sliding member are respectively provided with a downward inclined plane.

6. The modular structure of the interior assembly according to claim 1, wherein a lower surface of the second protrusion is an upward inclined plane, and an inclination angle of the upward inclined plane corresponds to an angle formed between the first protrusion and the sliding member.

7. The modular structure of the interior assembly according to claim 1, wherein a radian of the step-like member is matched with a radian of the sliding member, and the step-like member and the sliding member are directly fixed by the snap-fit connection.

* * * * *